US008641582B2

(12) United States Patent
Ahmadi Mirghaed

(10) Patent No.: US 8,641,582 B2
(45) Date of Patent: Feb. 4, 2014

(54) LEG-STRETCHING EXERCISE APPARATUS

(76) Inventor: Fariborz Ahmadi Mirghaed, Tehran (IR)

( * ) Notice: Subject to any disclaimer, the term of this patent is extended or adjusted under 35 U.S.C. 154(b) by 289 days.

(21) Appl. No.: 13/317,172

(22) Filed: Oct. 12, 2011

(65) Prior Publication Data

US 2012/0035028 A1 Feb. 9, 2012

(51) Int. Cl.
*A63B 21/00* (2006.01)

(52) U.S. Cl.
USPC ..... 482/79; 482/51; 482/907; 482/80

(58) Field of Classification Search
USPC ..... 482/80, 907, 79, 74, 96, 124, 121; 602/23
See application file for complete search history.

(56) References Cited

U.S. PATENT DOCUMENTS

| | | | | |
|---|---|---|---|---|
| 5,147,266 | A * | 9/1992 | Ricard | 482/131 |
| 5,209,711 | A * | 5/1993 | Scrima | 482/70 |
| 5,234,392 | A * | 8/1993 | Clark | 482/54 |
| 5,279,532 | A * | 1/1994 | Chen | 482/71 |
| 5,295,935 | A * | 3/1994 | Wang | 482/130 |
| 5,328,427 | A * | 7/1994 | Sleamaker | 482/71 |
| 5,520,598 | A * | 5/1996 | Little | 482/79 |
| 6,264,584 | B1 * | 7/2001 | Bass | 482/54 |
| 7,179,206 | B2 * | 2/2007 | Backes et al. | 482/80 |

* cited by examiner

*Primary Examiner* — Jerome W Donnelly
(74) *Attorney, Agent, or Firm* — Patent 360 LLC

(57) ABSTRACT

Disclosed is a leg-stretching exercise apparatus comprising a base, a handle connected to the base about a front vertical member assembly extending from the front thereof, a waist belt extending from a rear vertical member extending from the rear of the base, and a pair of generally horizontal track assemblies extending collinearly from either side of the base. Each track assembly comprises at least one rail pipe extending between a pair of proximal and distal blocks, a foot-supporting platform coupled to the at least one rail pipe such that the platform can slide along the length thereof, and a resilient member connecting the platform to the proximal block.

17 Claims, 6 Drawing Sheets

LEG-STRETCHING EXERCISE APPARATUS

BACKGROUND OF THE INVENTION

1. Field of the Invention

The present invention relates to exercise equipment and more particularly to an exercise apparatus for aiding an exerciser in performing a leg-stretching exercise.

2. Background Art

Leg-stretching exercise is a very popular exercise performed by athletes, gymnasts, martial artists, dancers, sportsmen, and so on, usually on a day basis. The leg-stretching exercise basically comprises alternatively performing the steps of spreading the legs apart to the point of maximum separation and drawing them back together. The act of spreading the legs apart is also known as performing a split.

Usually, an exerciser, while performing the leg-stretching exercise, especially the split, utilizes his/her body weight to push and gradually slide the legs apart while relaxing the muscles thereof. If proper control is not exercised over the same, it leads to, at a minimum, pulling a muscle, which in turn leads to a painful injury. The leg-stretching exercise also entails the exerciser to rise against the weight of his/her body while retracting his/her legs back together. This may cause a certain amount discomfort to the exerciser. Choice of the surface whereon the leg-stretching exercise is performed is another crucial factor. While a rough surface makes it difficult for the exerciser to slide the feet apart, a surface which is too smooth might cause the slippage of the feet leading to, again, a painful injury.

Several exercise apparatuses and devices are known in the art for aiding an exerciser in performing the leg-stretching exercise. Since the leg-stretching exercises are mostly performed on the exercise apparatuses, the aforementioned issue of inappropriate surfaces is taken care of.

U.S. Pat. No. 3,584,871 to Kehnon, Jr. discloses a Push-Pull Type Leg Stretching Device comprising a pair of linearly-displaceable platforms coupled together by a resilient means which enables the platforms to be alternatively extended apart a predetermined distance and drawn back together into an abutting relationship. An exerciser can perform the leg-stretching exercise thereon by placing his/her either foot on the pair of platforms and slide them apart and then draw them back. The resilient means exerts a counter force against the direction of the movement of the platforms while performing the split, thereby relieving the exerciser from the burden of controlling his/her body weight. Also, the resilient means eases the pressure of the body weight on the exerciser while retracting his/her feet owing to the counter force.

However, on the flipside, it is difficult for the exerciser to maintain the balance of the torso thereof on the leg stretching device during the exercise, especially when the exercise is performed in a quicker manner. Another disadvantage is the lack of a means for the feet to prop against so as to prevent the slippage thereof on the platforms.

U.S. Pat. No. 5,518,484 to Bruckenstein discloses a Leg Stretching Device comprising a slidable foot supporting plate mounted on a pair of rails extending between a pair of blocks. An exerciser, in order to perform the leg-stretching exercise, straddles one end of the device, places a foot on the supporting plate and obtains the desired stretch by urging the plate toward the other end. Bruckenstein's device, apart from sharing the torso-imbalance disadvantage of the Kehnon, Jr.'s device is also devoid of the utility offered by a resilient means of the Kehnon, Jr.'s device. Another disadvantage is owing to the single foot supporting plate which is, the exerciser, while performing the split, needs to ensure that the surface on which the Bruckenstein's device is placed should not be too smooth to cause slippage of his/her foot resting thereon.

U.S. Pat. No. 4,132,404 to Wilson discloses a Leg Stretching Exercise Device which is structurally similar in construction to the above discussed Kehnon, Jr's device except that, in the Wilson's invention a non-resilient means is employed in place of the resilient means. Therefore, the disadvantages of Kehnon, Jr's device and the disadvantages of not employing a resilient means apply to the Wilson's device.

Finally, U.S. Pat. No. 5,147,266 to Ricard discloses a Leg Stretching Machine for performing a Chinese split. The leg stretching machine comprises a base, two generally horizontal tracks extending collinearly from the base, a foot platform sliding on each track, and a vertical column with handles. The exerciser stands on the platforms, which travel outward from the base while the split is performed and maintains the balance by holding handles. The platforms are moved along the tracks by cables fixed on either side of each platform. The cables run over pulleys to a drum mounted in the column, which can be turned by a crank.

Although the Ricard's leg stretching machine enables an exerciser to balance the torso thereof by employing a column with handles to grab on to, and a mechanism of cables for dealing with the body weight, it is bulky, complex in construction. Also, the Ricard's machine is particularly designed for performing a Chinese split and therefore cannot be ideal for the leg-stretching exercise, where the exerciser may need to alternatively stretch and retract the legs in a quicker manner. Yet another disadvantage of the Ricard's machine is that the exerciser needs to control the displacement of the foot platform by operating the crank while performing a split, which is an additional task for the exerciser.

SUMMARY OF THE INVENTION

It is a primary object of the present invention to provide an exercise apparatus for enabling an exerciser to carry out a leg-stretching exercise thereon.

It is another object of the present invention to provide such an apparatus which employs a means for enabling an exerciser to maintain the balance of his/her torso while performing the leg-stretching exercise.

Another object of the present invention is to provide such an apparatus which employs a means for exerting resistance against the direction of the feet of the exerciser while performing a split thereby offering the exerciser a substantial control over performing the exercise.

It is still another object of the present invention to provide such an apparatus which is light and simple in construction.

Yet another object of the present invention is to provide such an apparatus, which can be foldable into a storage position.

The other objects of the embodiments herein will become readily apparent from the following detailed description taken in conjunction with the accompanying drawings.

FIGURES

Reference Numerals

10 . . . Leg-Stretching Exercise Apparatus
12 . . . Base Assembly
14 . . . Track Assembly
20 . . . Front Base Pipe
22 . . . Rear Base Pipe
24 . . . Front Column Pipe
26 . . . Handle
28 . . . Horizontal Rod
30 . . . Gripping Rod
32 . . . Rear Column Pipe
34 . . . Waist Belt
36 . . . Elastic Connector
38 . . . Rail Pipe
40 . . . Track Pipe
42 . . . Proximal Block
44 . . . Distal Block
46 . . . Foot-Supporting Platform
48 . . . Top Surface of the Foot-Supporting Platform
50 . . . Preventive Panel
52 . . . Bottom Piece
54 . . . Bearing Hole
56 . . . Elastic Rope
58 . . . Elastic Stopper
60 . . . Display Monitor

DETAILED DESCRIPTION OF A PREFERRED EMBODIMENT

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The present invention comprises an exercise apparatus for aiding an exerciser in performing a leg-stretching exercise. The leg-stretching exercise basically comprises alternatively performing the steps of spreading the legs apart usually to the point of maximum separation and drawing them back together. The step of spreading the legs apart is also known as performing a split. The exercise apparatus can be used for performing the two types of splits thereon, viz., side split, where the legs are extended to the left and right side of the torso, and front split, where one leg is extended to the forward, and the other leg to the rear of the torso.

Figure 1:
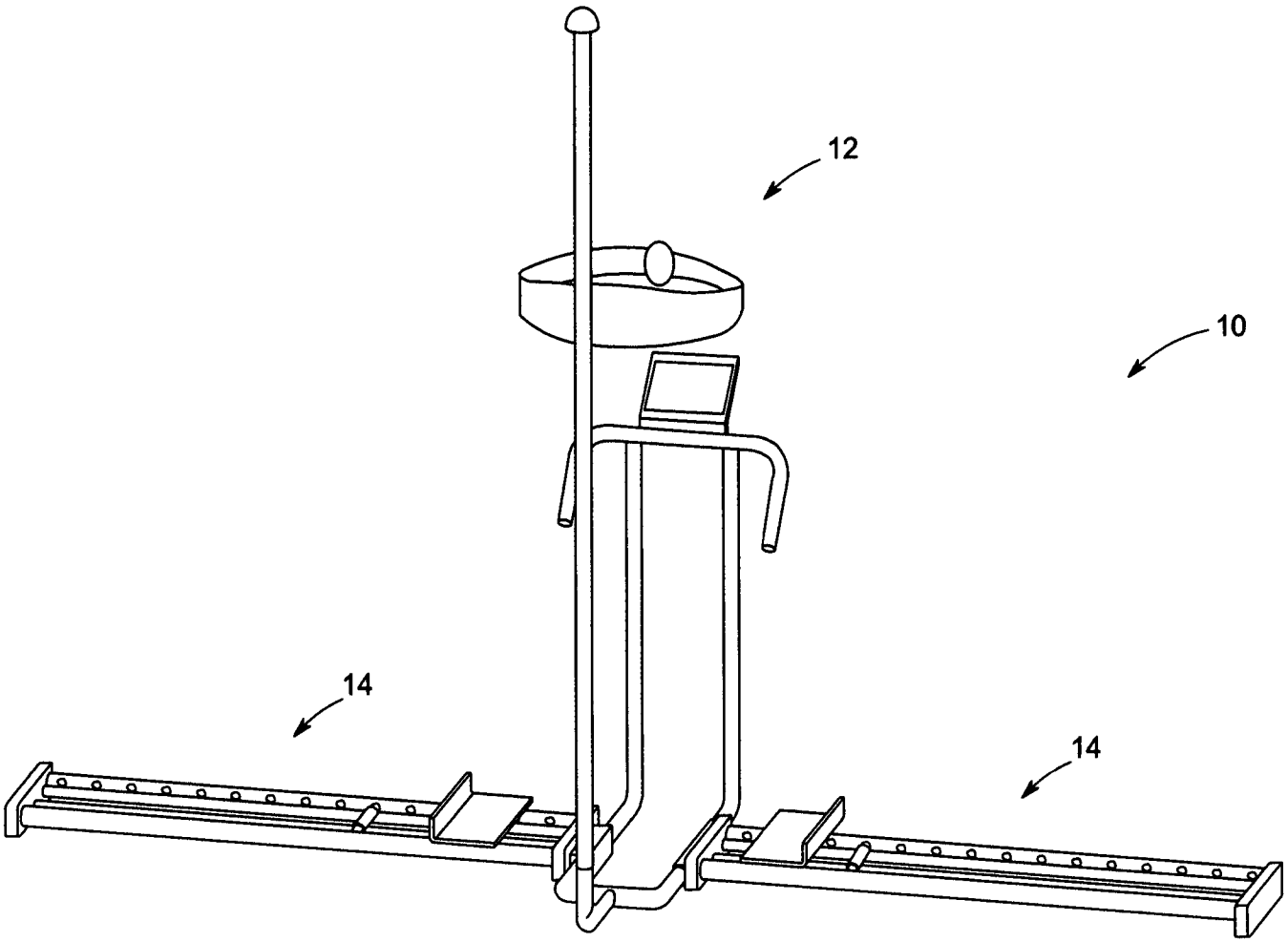
FIG. 1 is an illustration of a perspective view of the leg-stretching exercise apparatus of the present invention.
Figure 2:
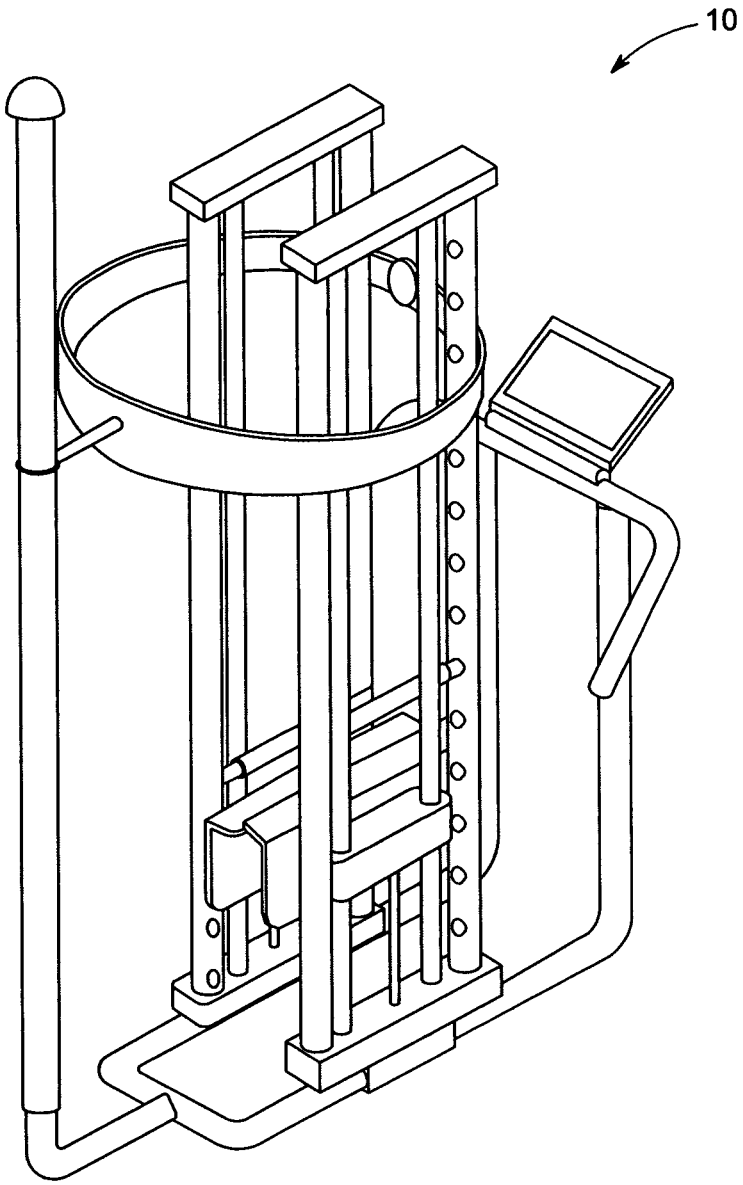
FIG. 2 is an illustration of a perspective view of the leg-stretching exercise apparatus in storage position.

Referring to FIG. 1, the apparatus 10 is broadly divided into a base assembly 12 and a pair of track assemblies 14. The track assemblies are 14 are hingedly connected to either side of the base assembly 12 such that track assemblies 14 can be folded upwardly about the hinges thereof so as to bring the apparatus into a storage position as seen in FIG. 2.

Figure 3:
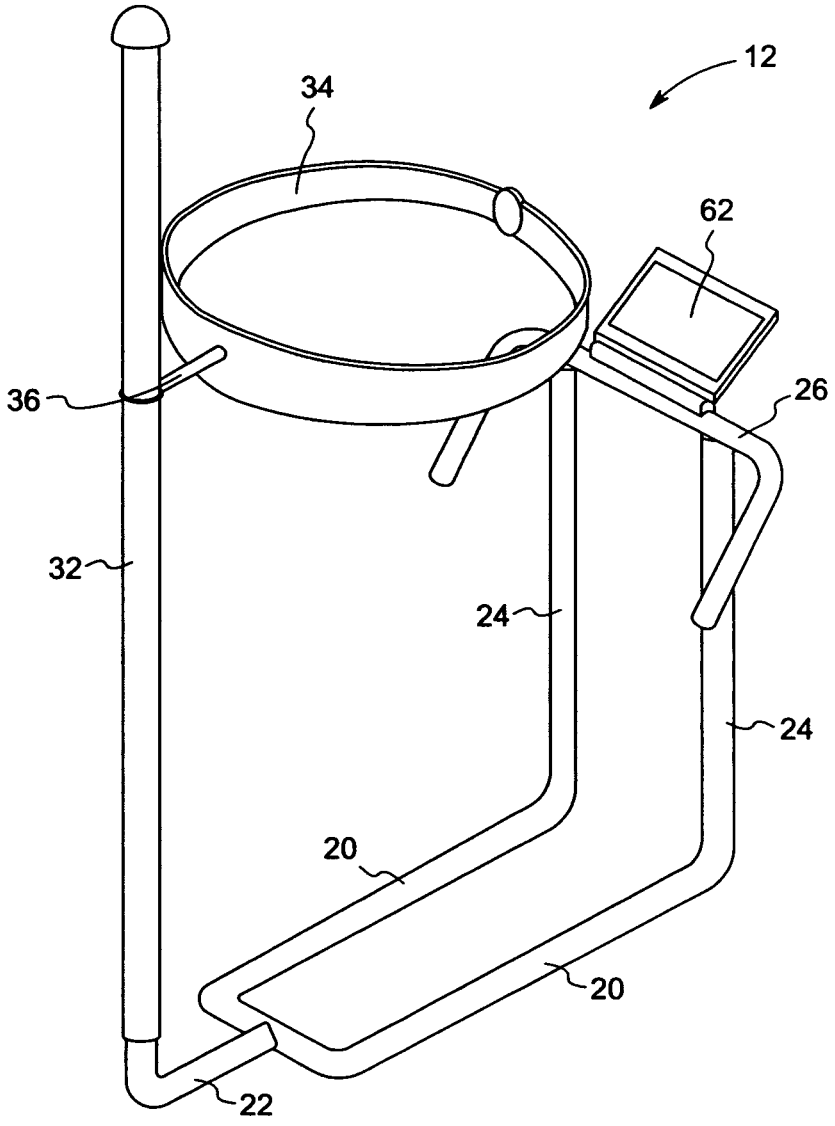
FIG. 3 is an illustration of a perspective view of the base assembly of the leg-stretching exercise apparatus.

Referring to FIG. 3, the base assembly 12 comprises a generally horizontal base, which is a unitary piece comprising a U-shaped frame defined by a pair of front base pipes 20 and a mid pipe connecting the ends of the front base pipes 20, and a rear base pipe 22, extending centrally and perpendicularly from the mid pipe in a direction opposite to that of the front base pipes 20. The base assembly 12 further comprises a pair of front column pipes 24, each of which extends from the free end of a front base pipe 20, and a handle 26 attached on top of the front column pipes 24.

Figure 4:
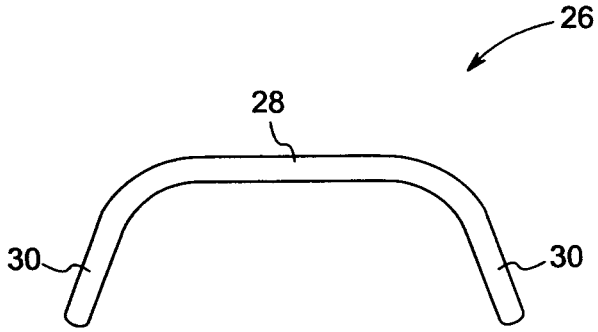
FIG. 4 is an illustration of the handle of the leg-stretching exercise apparatus.

Referring to FIG. 4, the handle 26 is employed for enabling the exerciser to balance his/her torso while performing the leg-stretching exercise on the apparatus 10. The handle 26 is a unitary piece comprising a horizontal rod 28, and a pair of gripping rods 30 extending downwardly from either end of the horizontal rod 28 at an obtuse angle to the horizontal rod 28 as shown in the figure. In one embodiment the height of the handle 26 is adjustable by perhaps employing a telescopic mechanism.

Referring back to FIG. 3, the base assembly 12 further comprises a rear column pipe 32, which extends from the free end of the rear base pipe 22. More particularly, the free end of the rear base pipe 22 terminates in an upward projection whereon the rear column pipe is mounted. A waist belt 34 is connected to the rear column pipe 32 about an elastic connector 36 wherein, the waist belt 34, as the term suggests, is secured around the waist of the exerciser while performing the leg-stretching exercise for safety reasons. The means of connection between the elastic connector 36 and the rear column pipe 32 is a ring through which the rear column pipe 32 is slidably received. Owing to the slidable relation between the ring and the rear column pipe 32, the vertical position of the waist belt 34 can be adjustable.

Figure 5:
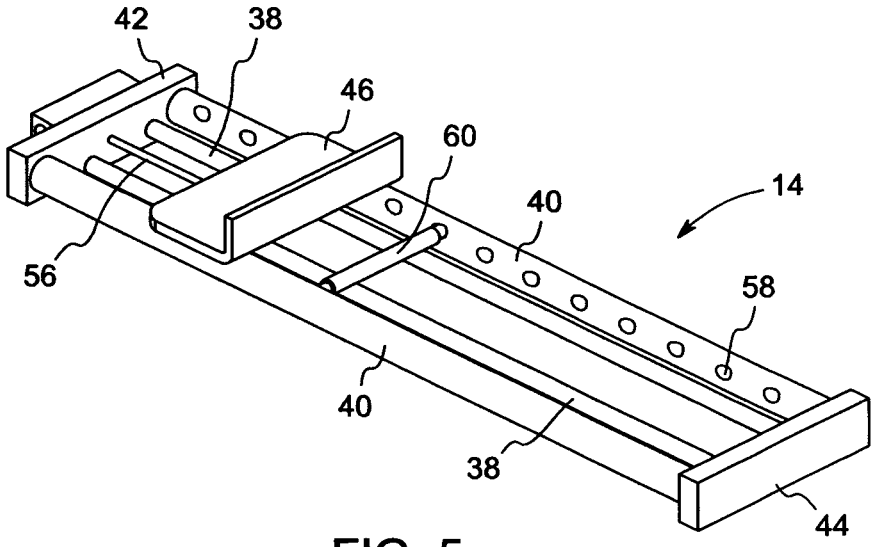
FIG. 5 is an illustration of a perspective view of the track assembly of the leg-stretching exercise apparatus.

Referring to FIG. 5, the track assembly 14 comprises a pair of rail pipes 38 and a pair of track pipes 40 disposed on either side of the pair of rail pipes 38. The rail and track pipes 38 and 40 extend between a pair of proximal and distal blocks 42 and 44. More particularly, each of the proximal and distal blocks 42 and 44 comprises holes of appropriate dimensions for receiving the extremities of the rail and track pipes 38 and 40 therewithin.

Figure 6:
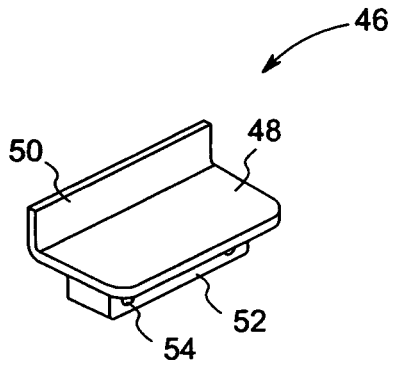
FIG. 6 is an illustration of a first perspective view of the foot-supporting platform of the leg-stretching exercise apparatus.
Figure 7:
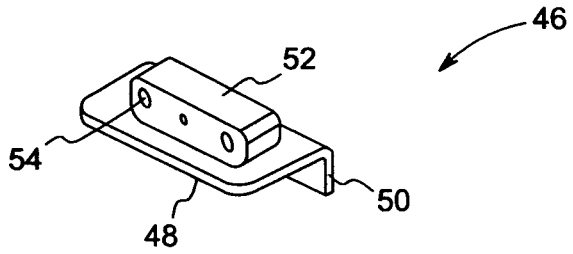
FIG. 7 is an illustration of a second perspective view of the foot-supporting platform of the leg-stretching exercise apparatus.

Referring to FIGS. 6 and 7, the track assembly 14 further comprises a foot-supporting platform 46 comprising a generally planar top surface 48 and a vertical preventive panel 50 extending upwardly from a distal edge of the planar top surface 48. The purpose of the preventive panel 50 is to prevent the slippage of the feet of the exerciser while performing the leg-stretching exercise, especially the split, on the apparatus 10.

Still referring to FIGS. 6 and 7, the platform 46 is coupled to the pair of rail pipes 38 such that the platform 46 slides along the length thereof. More particularly, the underside of the platform 46 is attached with a rectangular bottom piece 52 about one of non-cross-sectional surfaces thereof. The bottom piece 52 comprises a pair of spaced-apart cross-sectional bearing holes 54 wherein, each hole receives a cylindrical ball bearing therewithin. The rail pipes 38 are received within the cylindrical ball bearings therethrough thereby enabling the platform 46 to slide along the length of the pair of rail pipes 38. In one embodiment of the apparatus 10, the track assembly 14 doesn't include the rail pipes 38 and the platform 46 is coupled to the track pipes 40 in the same manner as that of the rail pipes 38.

Referring to FIGS. 5 through 7, the track assembly 14 further comprises an elastic rope 56 connecting the bottom piece 52 and the proximal block 42 so as to resist the movement of the platform 46 towards the distal block 44. The advantage of employing the elastic rope 56 is twofold. Firstly, it would help the exerciser to exercise better control over the split by not having to worry about controlling his/her body weight, and secondly, it eases the pressure on the exerciser while the he/she rises against his/her body weight during retraction.

Referring again to FIG. 5, each track pipe 40 comprises a plurality of track holes 58 disposed along the length thereof. An elastic stopper 60 is received within two opposing holes 58 of the opposing track pipes 40. The stopper 60 is basically employed for restricting the movement of the platform 46 between the proximal block 42 and the stopper 60. More particularly, the platform 46 comes to a halt as the bottom piece 52 comes in contact with the stopper 60.

Referring back to FIGS. 1 and 3, the base assembly 12 further comprises a display monitor 62 affixed atop the handle 26. The monitor 62 may be an LCD monitor of any suitable resolution. The monitor 62 is meant for displaying the information comprising the heartbeat rate of exerciser, the number of calories burnt, the range of the movement of the platform while performing the leg-stretching exercise.

Figure 8:
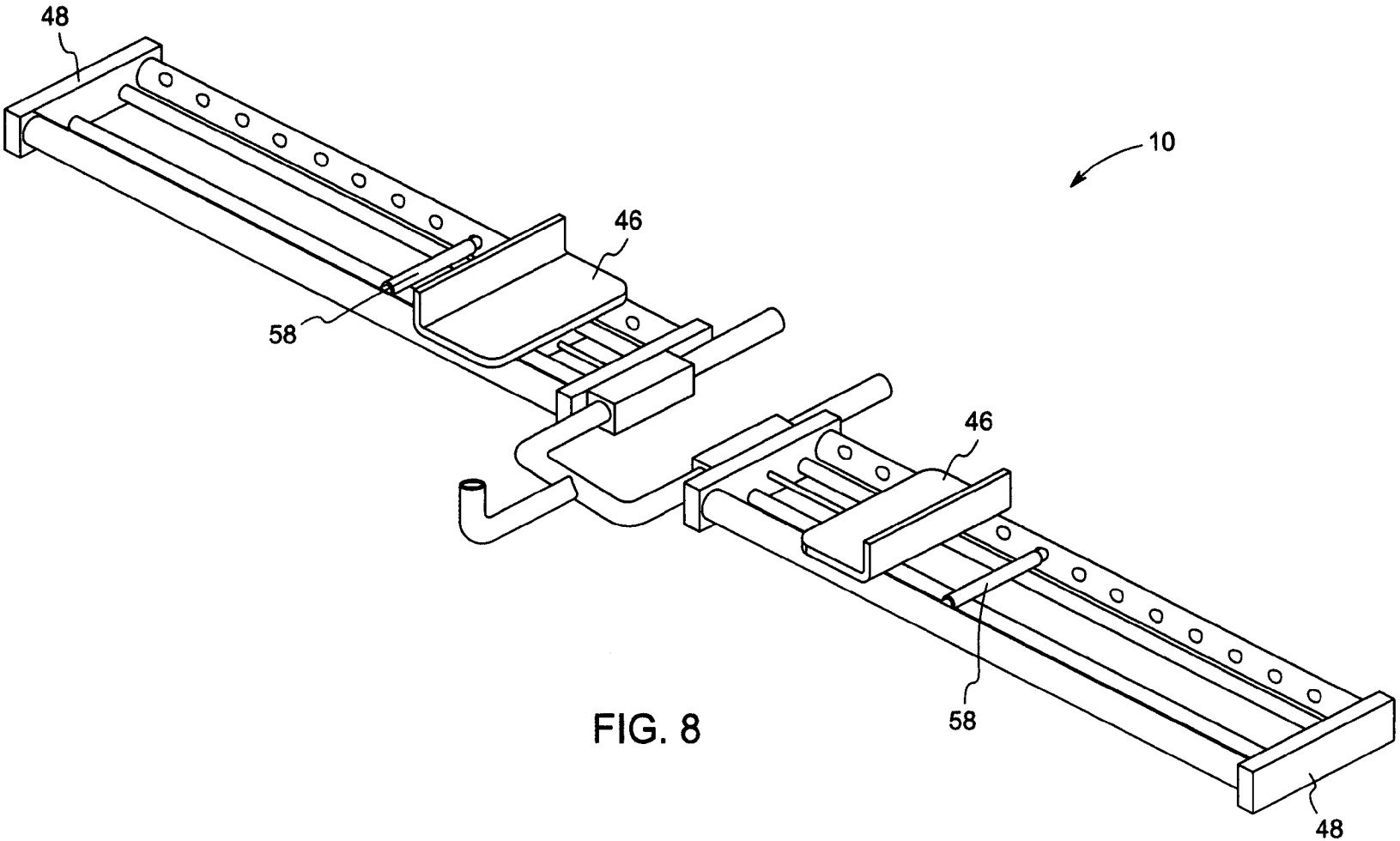
FIG. 8 is an illustration of a perspective view of the leg-stretching exercise apparatus sans the front and rear column pipes.

The apparatus 10 can be alternatively used for performing push-ups. In order to use the apparatus for push-ups, the front and rear column pipes are removed as seen in FIG. 8, and the hands of the exerciser are to be placed on the platforms 46 and urged so as to move the platforms 46 toward the distal block 44. The stopper 58 may be employed for restricting the range of the movement of the platform 46.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall therebetween.

What is claimed is:

1. A leg-stretching exercise apparatus comprising:

(a) a base;

(b) a handle for enabling an exerciser to balance the torso thereof while performing the leg-stretching exercise, the handle connected to the base about a front vertical member assembly extending from the front thereof;

(c) a waist belt attached to a rear vertical member extending from the rear of the base; and (d) a pair of generally horizontal track assemblies extending collinearly from either side of the base, each track assembly comprising:

(i) at least one rail pipe extending between a pair of proximal and distal blocks;

(ii) a foot-supporting platform coupled to the at least one rail pipe such that the platform slides along the length thereof; and (iii) a resilient member connecting the platform to the proximal block; the resilient member offering resistance against the movement of the platform towards the distal block.

2. The apparatus of claim 1 wherein, the front vertical member assembly comprises at least one front column pipe.

3. The apparatus of claim 2 wherein, the at least one front column pipe comprises a pair of front column pipes.

4. The apparatus of claim 1 wherein, the rear vertical member comprises a rear column pipe.

5. The apparatus of claim 4 comprising an elastic connector connecting the waist belt to the rear column pipe.

6. The apparatus of claim 1 wherein, the height of the handle is adjustable.

7. The apparatus of claim 1 comprising a monitor for displaying information comprising the heartbeat rate of the exerciser and the number of calories burnt; the monitor attached to the handle.

8. The apparatus of claim 1 wherein, the at least one rail pipe comprises a pair of rail pipes.

9. The apparatus of claim 8 wherein, the bottom of the platform comprises a pair holes within which a pair of cylindrical ball bearings are received, each cylindrical ball bearing to slidably receive a rail pipe therethrough.

10. The apparatus of claim 1 wherein, the track assembly further comprises a pair track pipes extending between the pair of proximal and distal blocks, the pair of track pipes disposed on either side of the at least one rail pipe, each track pipe comprising a plurality of holes disposed along the length thereof, a stopper, which limits the range of the movement of the platform, is to be received between two opposing holes of the opposing track pipes.

11. The apparatus of claim 10 wherein, the platform comprises a vertical preventive panel extending from a distal edge thereof, the preventive panel for preventing the slippage of the leg of the exerciser while performing the leg-stretching exercise, the preventive panel restricting the movement of the platform beyond the stopper.

12. The apparatus of claim 10 wherein, the stopper is elastic.

13. The apparatus of claim 1 wherein, the pair of track assemblies are hinged to the either side of the base whereby, each track assembly can be folded about the hinges into a storage position.

14. The apparatus of claim 1 wherein, the handle is a unitary piece comprising a horizontal rod, and a pair of gripping rods extending downwardly from the either end of the horizontal rod.

15. The apparatus of claim 1 wherein, the resilient member comprises an elastic rope.

16. The apparatus of claim 1 wherein, the base is generally horizontal comprising:

(a) a U-shaped frame comprising a pair of parallel front base pipes connected by a mid pipe, the front vertical member assembly extending from the free ends of the pair of front base pipes; and (b) a rear base pipe centrally extending from the mid pipe and away from the front base pipes such that the rear base pipe is disposed perpendicular to the mid pipe, the rear vertical member extending from the free end of the rear base pipe.

17. A leg-stretching exercise apparatus comprising:

(a) a generally horizontal base frame;

(b) a height-adjustable handle for enabling a exerciser to balance the torso thereof while performing the leg-stretching exercise, the handle connected to the base about a pair of front column pipes extending from the front thereof;

(c) a waist belt connected to a rear column pipe about an elastic connector, the rear column pipe extending from the rear of the base; and (d) a pair of generally horizontal track assemblies extending collinearly from either side of the base, each track assembly comprising:

(i) a pair of proximal and distal blocks;

(ii) a pair of rail pipes extending between the pair of proximal and distal blocks;

(iii) a foot-supporting platform coupled to the pair of rail pipes such that the platform can slide along the length thereof;

(iv) an elastic rope connecting the platform to the proximal block;

(v) an elastic stopper for limiting the range of the movement of the platform; and (vi) a pair of track pipes extending between the pair of proximal and distal blocks, the pair of track pipes disposed on either side of the pair of rail pipes, each track pipe comprises a plurality of equidistant holes disposed along at least a portion the length thereof, the stopper to be received between two opposing holes of the opposing track pipes.

* * * * *